US006463702B1

(12) United States Patent
Weaver et al.

(10) Patent No.: US 6,463,702 B1
(45) Date of Patent: Oct. 15, 2002

(54) CONCRETE SAFE ROOM

(75) Inventors: Gary L. Weaver, Ephrata; Robert G. Martin, Narvon, both of PA (US)

(73) Assignee: SWA Holding Company, Inc., Wilmington, DE (US)

( * ) Notice: Subject to any disclaimer, the term of this patent is extended or adjusted under 35 U.S.C. 154(b) by 0 days.

(21) Appl. No.: 09/698,726

(22) Filed: Oct. 27, 2000

Related U.S. Application Data

(60) Provisional application No. 60/162,796, filed on Nov. 1, 1999.

(51) Int. Cl.[7] ..... E04B 1/00

(52) U.S. Cl. ..... 52/79.1; 52/250; 52/251; 52/404.1; 52/236.9; 52/309.12

(58) Field of Search ..... 52/79.1, 79.14, 52/404.1, 405.1, 309.12, 309.17, 414, 284, 782.1, 272, 250, 251, 602, 236.9, 236.6

(56) References Cited

U.S. PATENT DOCUMENTS

| | | | | | |
|---|---|---|---|---|---|
| 2,592,634 | A | * | 4/1952 | Wilson | 52/584.1 |
| 3,596,417 | A | * | 8/1971 | Zachry | 52/73 |
| 4,030,262 | A | * | 6/1977 | Dean | 52/583 |
| 5,493,838 | A | * | 2/1996 | Ross | 52/745.1 |
| 5,865,001 | A | * | 2/1999 | Martin et al. | 52/309.12 |
| 6,003,278 | A | * | 12/1999 | Weaver et al. | 52/414 |
| 6,151,843 | A | * | 11/2000 | Weaver et al. | 52/92.2 |

* cited by examiner

*Primary Examiner*—Carl D. Friedman
*Assistant Examiner*—Jennifer I. Thissell
(74) *Attorney, Agent, or Firm*—Buchanan Ingersoll, P.C.

(57) ABSTRACT

A system for forming a safe room including a plurality of preformed concrete wall panels and a roof panel. Each panel includes an extension portion and a top beam which together define a shelf. The wall panels are interconnected to define a generally continuous perimeter shelf. The roof panel is positioned within the room perimeter and is set upon and secured to the generally continuous shelf.

22 Claims, 4 Drawing Sheets

CONCRETE SAFE ROOM

This application claims the benefit of U.S. Provisional Application No. 60/162,796 filed Nov. 1, 1999.

BACKGROUND OF THE INVENTION

The present invention relates generally to the field of prefabricated concrete wall construction, and more specifically, to a safe room constructed of prefabricated concrete wall panels.

Every year, hundreds of people are killed by natural disasters including hurricanes, tropical storms and the like. Many of these deaths are attributable to flying debris. For example, typical wall studs are often dislodged and hurled through the air at speeds upwards of 100 miles per hour. These airborne studs become missiles which can easily travel through standard stick frame construction. As a result, people in the path of a storm generally do not have a place to hide from these objects and must rely on circumstance to avoid being struck and injured or killed.

An additional problem experienced during such natural disasters is the failure, and thereby the removal of roofs from places of shelter. Once the roof of the structure is removed, the people inside become at greater risk of being struck by flying and falling debris.

Accordingly, there is a need for a safe heaven for people to retreat to during storms which is less susceptible to the above problems.

SUMMARY OF THE INVENTION

The present invention relates to a system for forming a safe room. A plurality of preformed concrete wall panels are interconnected to form a room perimeter. Each panel includes an extension portion and a top beam which together define a shelf. A roof panel is positioned within the room perimeter and is set upon and secured to the generally continuous shelf defined by the interconnected panels such that the roof is slightly recessed.

DETAILED DESCRIPTION OF THE PREFERRED EMBODIMENT

Figure 1:
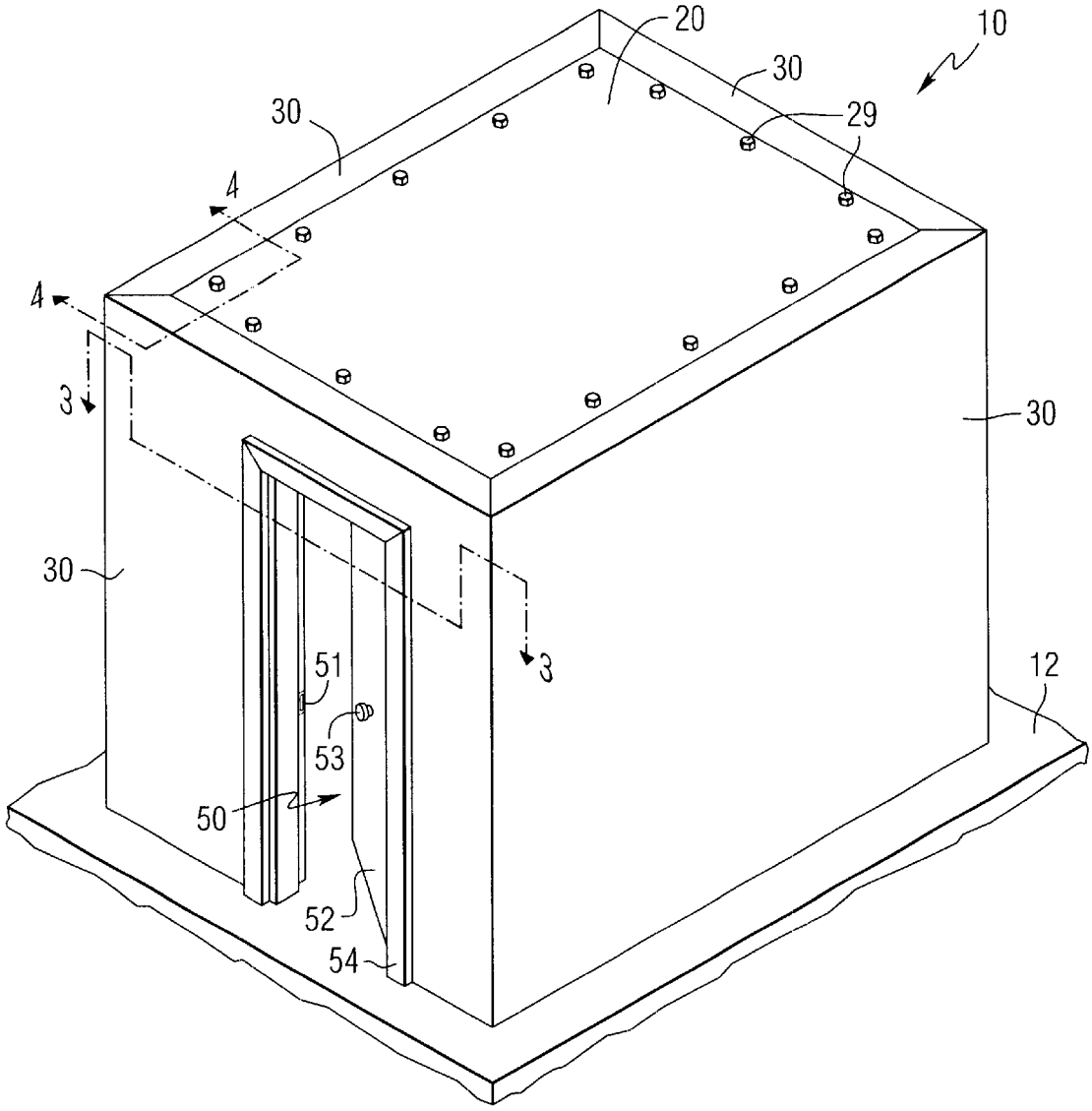
FIG. 1 is a perspective view of a safe room in accordance with the present invention.

The preferred embodiments will be described with reference to the drawing figures wherein like numerals represent like elements throughout. References to orientation refer to the orientation of an installed wall panel and are for clarity only.

FIG. 1 shows a preferred safe room 10 made in accordance with the present invention. The safe room 10 generally includes a plurality of prefabricated wall panels 30 which are connected to form a room perimeter. Each panel 30 is secured to a slab 12 or other foundation member. The room perimeter is preferably defined within and consistent with the remainder of the building structure. For example, the room 10 can be the master closet of a house or an office in a building. A roof panel 20 sits recessed within the room perimeter on a generally continuous shelf (not shown) defined by the wall panels 30. A doorway 50 permits entrance and exit from the room 10.

Figure 2:
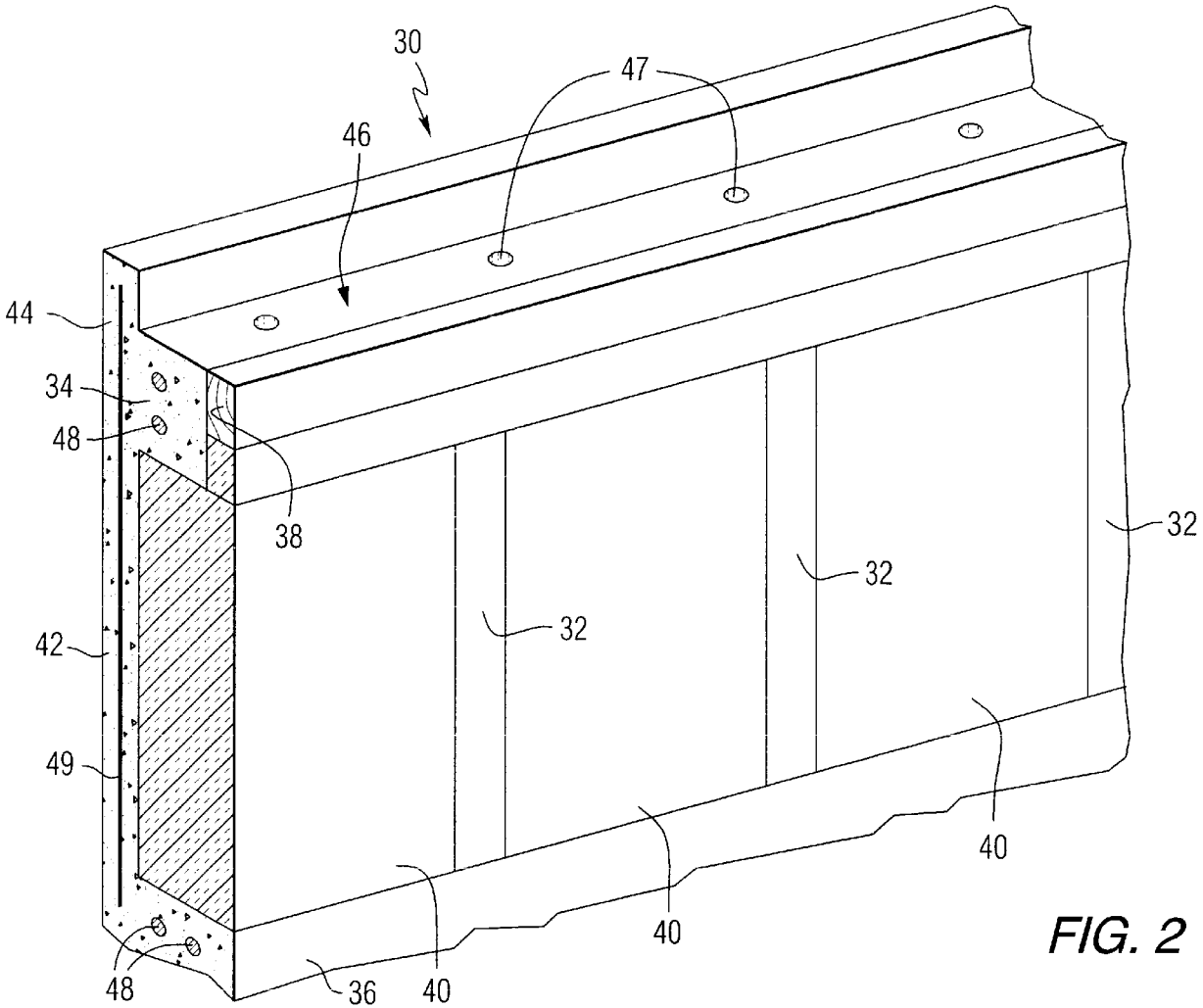
FIG. 2 is a perspective view of a wall panel made in accordance with the present invention.
Figure 3:
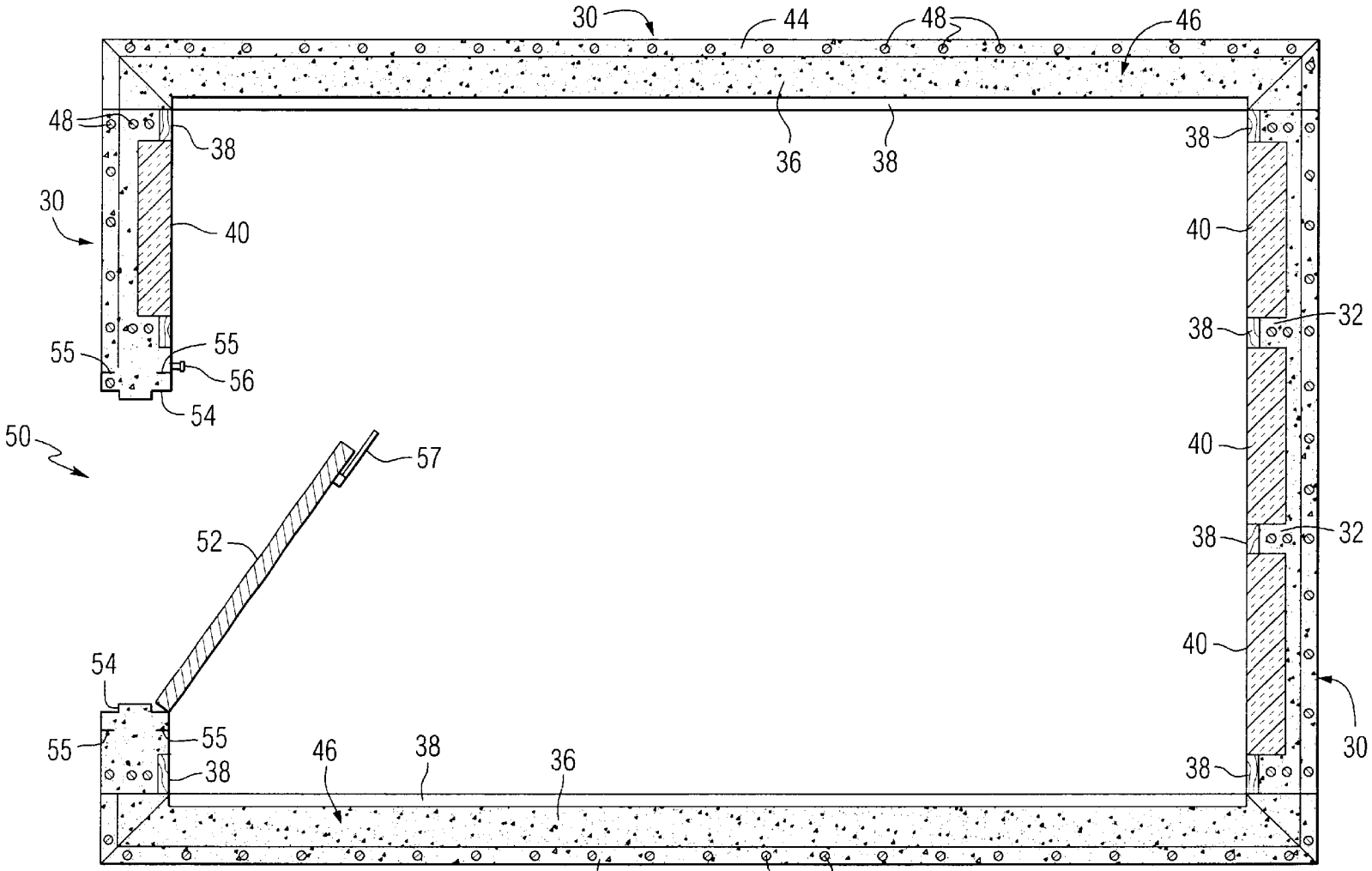
FIG. 3 is a section view taken along the line 3—3 in FIG. 1.

FIG. 2 shows a preferred planar wall panel 30 made in accordance with the present invention. The planar wall panel 30 has a solid portion which includes spaced vertical studs 32 extending between a top beam 34 and a base beam 36. Nailing strips 38 are preferably formed integral with the vertical studs 32 and the top and base beams 34, 36. Insulation panels 40 extend between the vertical studs 32, and with studs 32, form a solid planar inside face on the wall 30. The outside face of the wall has a solid planer concrete surface 42. The concrete surface 42 includes an extended portion 44 extending above the top beam 34. The extended portion 44 and the top beam 36 define a shelf 46 for supporting the roof panel 46. The shelf 46 includes a number of anchor receptacles 47 for securing the roof panel 46 as will be described hereinafter. Referring to FIGS. 1 and 3, a number of steel reinforcement rods 48 are positioned in the wall panel 30. A wire lath 49 may also be included behind the insulation panels across the entire area of the wall panel 30. The preformed wall panels 30 may also be cavity walls, wherein the insulation panels 40 are recessed from the inside face of the wall 30, or other variations of concrete wall panels including an extended portion 44 to define a support shelf 46.

Referring to FIGS. 1 and 3, adjacent wall panels 30 are butted and secured to one another using any of a number of attachment methods. As shown in FIG. 3, the panels 30 are preferably mitered, but may have flat ends which are overlapped or connected through a separate comer piece. If overlapped or connected through a comer piece, the components are preferably configured such that the shelf remains continuous about the perimeter. For example, the comer piece may be formed with a defined shelf portion. With the panels 30 secured, a generally continuous shelf 46 is defined around the perimeter of the safe room 10 with a number of anchor receptacles 47. Although the illustrated wall panels 30 define a rectangular perimeter, the wall panels 30 can be configured to define any desired room configuration.

Figure 4:
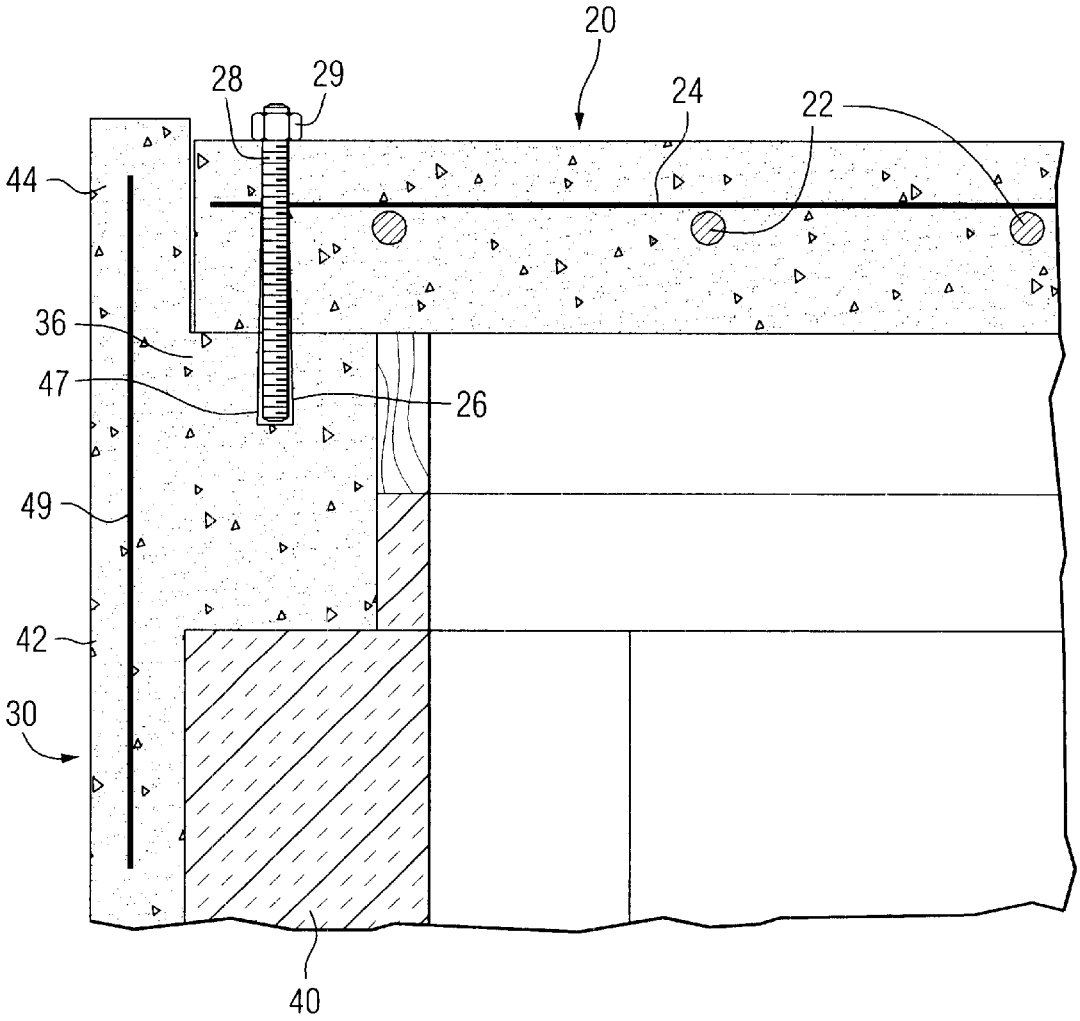
FIG. 4 is a partial section view taken along the line 4—4 in FIG. 1.

The roof panel 20 will be formed with a configuration complementary to the room perimeter configuration. Referring to FIG. 4, the roof panel 20 is preferably a solid concrete slab reinforced with steel reinforcement rods 22 and a wire lath 24. The roof panel 20 is preferably five inches (5") thick, but can be made to any desired thickness. The height of the wall panel extensions 44 will correspond to the slab thickness such that the roof panel 20 is flush with or slightly recessed from the top of the wall panels 30. This makes the roof panel 20 less likely to be subjected to wind or flying debris, and therefore, less susceptible to failure. The roof panel 20 includes a plurality of bores 26 which align with the anchor receptacles 47 in the wall panels 30. Anchor bolts 28 are positioned in the receptacles 47, extend through the bores 26, and are secured by a nut 29.

Referring to FIGS. 1 and 3, one of the panels 30 is provided with a doorway 50. The doorway 50 preferably includes a jam 54 from which is hung a solid steel door 52. The door 52 preferably opens inward to avoid debris blockage and to reduce the risk of outward suction by an external wind force. The door 52 includes a lock bolt 53 which mates within a reinforced lock plate 51 in the jam 54. Additional securing means 56, for example a pivotable latch, may be preformed in the wall panel 30 and mate with a catch 57 on the door 52 for additional fortification. The door jam 54 includes returns 55 which extend into the concrete such that the jam 54 can be preformed in the wall panel 30 to reduce its likelihood of failure. To ensure proper operation of the door 52 in the jam 54, the door 52 or a blank (not shown) having the same size and shape is positioned in the jam 54 during pouring of the wall panel 30.

What is claimed is:

1. A preformed concrete wall panel comprising:

a generally formed planar concrete surface;

a concrete top beam extending from the concrete surface generally perpendicular thereto; and a concrete extension portion having a top plane and extending from the concrete surface generally parallel thereto and perpendicular to the top beam whereby the extension portion and the top beam define a shelf adapted to receive and support a portion of a roof panel such that the top plane extends along or above an upper surface of the roof panel.

2. The preformed concrete wall panel of claim 1 wherein insulating material is positioned on an inside face of the concrete surface.

3. The preformed concrete wall panel of claim 1 further comprising a base beam extending from the concrete surface generally perpendicular thereto.

4. The preformed concrete wall panel of claim 3 wherein concrete vertical studs extend between the top and base beams.

5. The preformed concrete wall panel of claim 4 wherein nailing strips are integrally formed with the vertical studs and the top and base beams.

6. The preformed concrete wall panel of claim 1 wherein the shelf includes anchor receptacles for securing the roof panel thereto.

7. The preformed concrete wall panel of claim 1 wherein reinforcement rods are positioned in the concrete surface.

8. The preformed concrete wall panel of claim 1 wherein a wire lath is positioned in the concrete surface.

9. A system for forming a safe room comprising:

a plurality of performed concrete wall panels, each comprising:

a generally planar concrete surface;

a concrete top beam extending from the concrete surface generally perpendicular thereto; and a concrete extension portion extending from the concrete surface generally parallel thereto and perpendicular to the top beam whereby the extension portion and the top beam define a shelf wherein the wall panel extension portion defines a top plane and the roof panel has an upper surface that extends along or below the top plane;

means for connecting the wall panels to define a room perimeter with a generally continuous shelf;

a preformed concrete room panel positionable within the room perimeter upon the generally continuous shelf; and means for ingress and egress.

10. The system of claim 9 wherein insulating material is positioned on an inside face of the concrete surfaces.

11. The system of claim 9 wherein the wall panels each further comprise a base beam extending from the concrete surface generally perpendicular thereto.

12. The system of claim 11 wherein concrete vertical studs extend between the top and base beams.

13. The system of claim 12 wherein nailing strips are integrally formed with the vertical studs and the top and base beams.

14. The system of claim 9 wherein the shelf includes anchor receptacles for securing the roof panel thereto.

15. The system of claim 14 wherein the roof panel includes a plurality of bores which align with the anchor receptacles in the shelf.

16. The system of claim 15 wherein anchor bolts are positioned in the anchor receptacles, extended through the bores and secured by a nut.

17. The system of claim 9 wherein the means for ingress and egress is a doorway in one of the panels, the doorway including a jam, a solid steel door hung from the jam and a securing means.

18. The system of claim 17 wherein the securing means includes a lock bolt which mates within a reinforced lock plate.

19. The system of claim 17 wherein the jam is preformed within the respective panel.

20. The system of claim 17 wherein the door opens into the defined perimeter.

21. The system of claim 9 wherein the roofpanel is a solid concrete slab reinforced with steel reinforcement rods and a wire lath.

22. The system of claim 9 wherein adjacent wall panels are connected using a separate comer piece having a shelf portion defined therein such that the shelf remains continuous about the perimeter.

* * * * *